US005664771A

United States Patent [19]

Nagatani et al.

[11] Patent Number: 5,664,771

[45] Date of Patent: Sep. 9, 1997

[54] SHEET FEED MECHANISM HAVING PLURAL INDEPENDENT FEED ROLLERS AND PLURAL SENSOR ARRANGEMENT

[75] Inventors: Hiroyuki Nagatani, Tokyo; Isamu Nakabayashi, Kanagawa, both of Japan

[73] Assignee: NEC Corporation, Tokyo, Japan

[21] Appl. No.: 597,578

[22] Filed: Feb. 2, 1996

[30] Foreign Application Priority Data

Feb. 10, 1995 [JP] Japan ..... 7-023065

[51] Int. Cl.[6] ..... B65H 5/00; B65H 3/06

[52] U.S. Cl. ..... 271/10.03; 271/10.13; 271/116; 271/117; 271/122; 271/265.02

[58] Field of Search ..... 271/2, 10.03, 10.05, 271/10.11, 10.09, 10.13, 116, 117, 122, 265.01, 265.02

[56] References Cited

U.S. PATENT DOCUMENTS

| | | | |
|---|---|---|---|
| 4,077,620 | 3/1978 | Frank et al. | 271/10.03 |
| 4,171,130 | 10/1979 | Jeschke et al. | 271/10.03 |
| 4,522,385 | 6/1985 | Stefansson | 271/10.11 |
| 4,573,673 | 3/1986 | Haug | 271/10.03 X |
| 5,129,642 | 7/1992 | Suyatsky et al. | 271/10.03 |

FOREIGN PATENT DOCUMENTS

| | | | |
|---|---|---|---|
| 26 13 261 | 1/1978 | Germany . | |
| 30 47 278 | 7/1982 | Germany . | |
| 61-106354 | 5/1986 | Japan . | |
| 150639 | 6/1989 | Japan | 271/116 |
| 5-238577 | 9/1993 | Japan . | |
| 9075 | 1/1994 | Japan | 271/117 |
| 1594093 | 9/1990 | U.S.S.R. | 271/10.11 |

*Primary Examiner*—Boris Milef

*Attorney, Agent, or Firm*—Young & Thompson

[57] ABSTRACT

A sheet feed mechanism includes first, second, and third feed rollers, first and second servo motors, a reverse roller, a torque limiter, a pick-up roller, and a plurality of photoelectric sensors. The first, second, and third feed rollers are respectively mounted on a feed path of sheets including mail pieces, on an upstream side of the first feed roller in the feed direction, and on the upstream side of the second feed roller in the feed direction, and are respectively rotated by the one-way clutches in only a feed direction. The first and second servo motors respectively drive the first and second feed rollers, and the second feed roller independently. The reverse roller is pressed against by the first feed roller through the feed path, and is driven to rotate in a counter feed direction. The torque limiter constantly applies a predetermined driving torque to the reverse roller in the counter feed direction. The pick-up roller is arranged on a downstream side of the first feed roller in the feed direction, and is constantly rotated to feed the sheet to a downstream transport path. The plurality of photoelectric sensors are sequentially arranged on the feed path between the first feed roller and the pick-up roller.

8 Claims, 7 Drawing Sheets

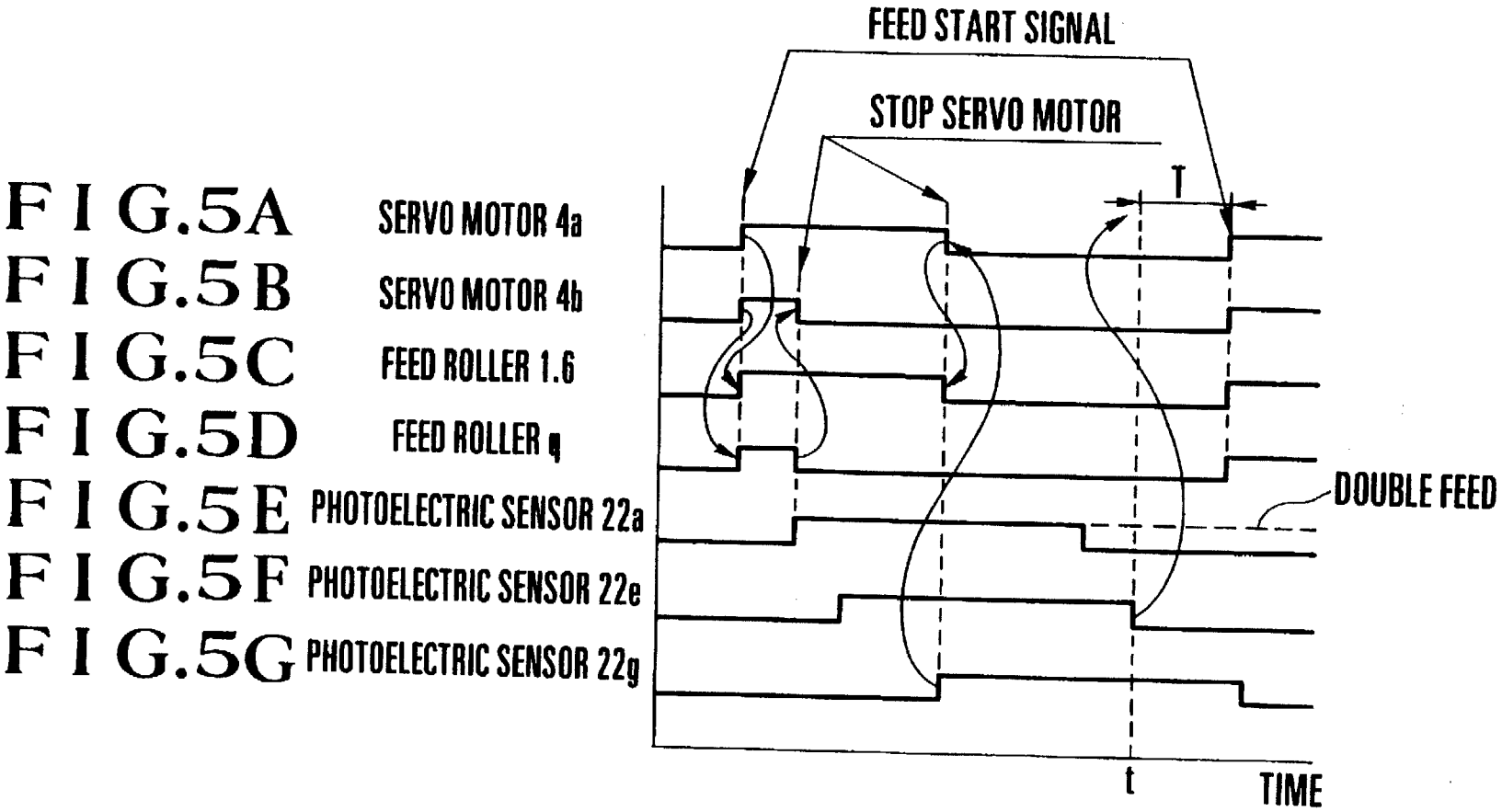
FEED START SIGNAL
STOP SERVO MOTOR
T
DOUBLE FEED
t
TIME
FIG.5A SERVO MOTOR 4a
FIG.5B SERVO MOTOR 4b
FIG.5C FEED ROLLER 1.6
FIG.5D FEED ROLLER
FIG.5E PHOTOELECTRIC SENSOR 22a
FIG.5F PHOTOELECTRIC SENSOR 22e
FIG.5G PHOTOELECTRIC SENSOR 22g

SHEET FEED MECHANISM HAVING PLURAL INDEPENDENT FEED ROLLERS AND PLURAL SENSOR ARRANGEMENT

BACKGROUND OF THE INVENTION

The present invention relates to a sheet feed mechanism utilizing a frictional force which is applied to an automatic mail piece processing apparatus, e.g., an automatic mail piece arranging/stamping machine that, for example, detects a postage stamp of mail piece, stamps the mail piece, and thereafter arranges the mail piece such that the surfaces of the mail piece where the postage stamps are stuck are aligned.

Conventionally, sheet feed mechanisms of this type are used widely as the ADF mechanisms of office automation equipments represented by a copying machine and, e.g., one disclosed in Japanese Patent Laid-Open No. 61-106354 is known. In this sheet feed mechanism, as shown in FIGS. 7A, 7B, and 7C, an electromagnetic clutch 54 is provided between a driving shaft 52 of a first feed roller 51 and a gear 53 driven by a motor (not shown). A second feed roller 55 is driven by the driving shaft 52 through gear trains 56*a*, 56*b*, and 56*c* to rotate in the same direction as that of the first feed roller 51 in synchronism with it. The second feed roller 55 is pivotal about the driving shaft 52 as the center. A one-way clutch 57 for allowing rotation of the driving shaft 52 only in the feed direction is mounted, in one of bearings that support the driving shaft 52. A pick-up roller 58 is pressed against by a pinch roller 59 and is normally rotated in a transport direction. A driving shaft 62 of a torque limiter 61 that applies a torque to a reverse roller 60 is driven by the rotation of the pick-up roller 58 through gears 63*a*, 63*b*, 63*c*, and 63*d*. The driving shaft 62 of the reverse roller 60 is pivotal about a shaft 64 as the center.

When only one sheet 65 is fed to a portion between the first feed roller 51 and the reverse roller 60, since a torque generated by the friction of the sheet 65 with the reverse roller 60 and applied to the reverse roller 60 is set to be larger than the torque of the torque limiter 61, the reverse roller 60 is rotated in the sheet feed direction without causing a slip with the sheet 65. When two or more sheets 65 are transported to a portion between the second feed roller 55 and the reverse roller 60, the torque applied by the torque limiter 61 is larger than the torque generated by the friction between the sheets. Thus, the second and subsequent sheets are pushed back to the feed table, and the sheet 65 which is in contact with the first feed roller 51 is transported. This prevents double transport of the sheets 65.

After the sheets 65 are separated apart, when a sheet position detection sensor 66 detects that the leading end of one sheet 65 is caught by the pick-up roller 58 and the pinch roller 59, the electromagnetic clutch 54 is turned off, and this sheet 65 is transported by the pick-up roller 58 and the pinch roller 59. When the sensor 66 detects the trailing end of the sheet 65, the electromagnetic clutch 54 is turned on after a predetermined period of time, and feeding of the following sheet is started.

The conventional friction type sheet feed mechanism described above poses no problem when the types (thickness, weight, paper quality, and the like) of the sheets to be dealt with are limited and a high processing speed is not required, as in an office automation equipment represented by a copying machine. However, as in an automatic mail piece processing apparatus, when the types of sheets (mail piece) to be dealt with vary and the mail piece must be processed at a high speed (e.g., with a transport speed=3 m/s or more and a processing speed=at least about 10 items/second), following problems arise.

(1) When the sheet position detection sensor 66 is located at only a position on a line connecting the pick-up roller 58 and the pinch roller 59, an error in feed interval is increased due to variations in wait position of the leading end of mail piece which is fed as second or subsequent mail piece. When the processing ability of the downstream unit is considered, the feeding unit must feed the mail piece with at least a minimum interval with which the downstream unit can process the mail piece. Then, a waste interval occurs between the mail pieces due to the error in feed interval, and an improvement in processing speed cannot be achieved.

(2) Since the torque limiter 61 is directly coupled to a shaft coaxial with the rotating shaft of the reverse roller 60, the moment of inertia with respect to the pivot shaft of the reverse roller 60 is increased. When thick (about 6 mm) mail pieces enter, the reverse roller 60 pivots largely, so that the two mail pieces cannot be separated sufficiently. When the torque limiter 61 is directly coupled to the rotating shaft of the reverse roller 60, the moment of inertia with respect to the rotating shaft of the reverse roller 60 is increased. When two or more mail pieces enter, the rotation of the reverse roller 60 is switched from the feed direction to the counter feed direction, and hence it takes time to separate the mail pieces, so that double feed is increased undesirably.

(3) At the start of feeding, when mail piece is to be fed only with the second feed roller 55, if the mail piece is heavy (e.g., about 50 g or more), a slip occurs between the second feed roller 55 and the mail piece, thus easily causing jam. Assume that a third feed roller (not shown) is simply added on the upstream side of the second feed roller 55 in the feed direction and this third feed roller is started/stopped in the same manner as the second feed roller 55. If a short mail piece is fed, when its trailing end is separated from the third feed roller, its leading end does not reach the pick-up roller yet. Then, the third feed roller erroneously transports the second mail piece, resulting in double feed.

SUMMARY OF THE INVENTION

It is an object of the present invention to provide a sheet feed mechanism having a constant feed interval, thereby improving the processing speed.

It is another object of the present invention to provide a sheet feed mechanism that reliably prevents double feed.

It is still another object of the present invention to provide a sheet feed mechanism capable of stably feeding heavy mail piece or short mail piece.

In order to achieve the above objects, according to the present invention, there is provided a sheet feed mechanism comprising a first feed roller mounted on a feed path of sheets including mail piece and rotated by a first one-way clutch in only a feed direction, the first feed roller having a high-friction member on an outer circumference thereof, a second feed roller arranged on an upstream side of the first feed roller in the feed direction to be pivotal about the first feed roller as a center and rotated by a second one-way clutch in only the feed direction, the second feed roller having a high-friction member on an outer circumference thereof and pressing against a sheet stacked on a feed table in an upright state to feed out the sheet in the feed direction, a first servo motor for driving the first and second feed rollers, a reverse roller pressed against by the first feed roller through the feed path and driven to rotate in a counter feed direction, the reverse roller being rotatable both in the feed direction and the counter feed direction, a torque limiter for constantly applying a predetermined driving torque to the reverse roller in the counter feed direction, a pick-up roller arranged on a downstream side of the first feed roller in the feed direction and constantly rotated to feed the sheet to a downstream transport path, a third feed roller arranged on the upstream side of the second feed roller in the feed direction and rotated by a one-way clutch in only the feed direction, the third feed roller having a high-friction member on an outer circumference thereof and pressing against the sheet stacked on the feed table in the upright state, a second servo motor for driving the second feed roller independently, and a plurality of photoelectric sensors sequentially arranged on the feed path between the first feed roller and the pick-up roller.

BRIEF DESCRIPTION OF THE DRAWINGS

FIGS. 5A to 5G are timing charts of the sheet feed mechanism shown in FIG. 1;

DESCRIPTION OF THE PREFERRED EMBODIMENT

The present invention will be described with reference to the accompanying drawings.

Figure 1:
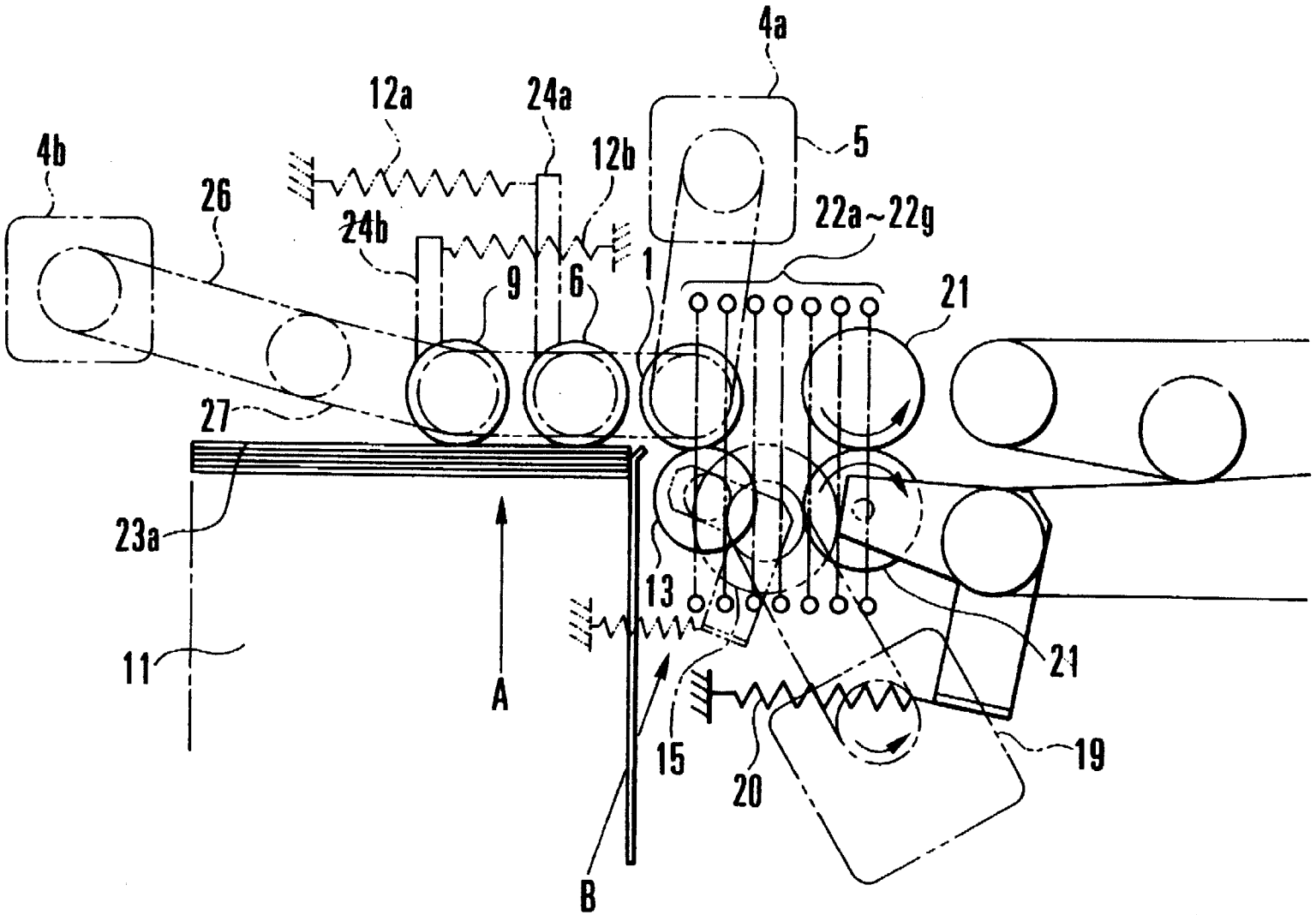
FIG. 1 is a plan view showing a sheet feed mechanism according to an embodiment of the present invention.
Figure 2:
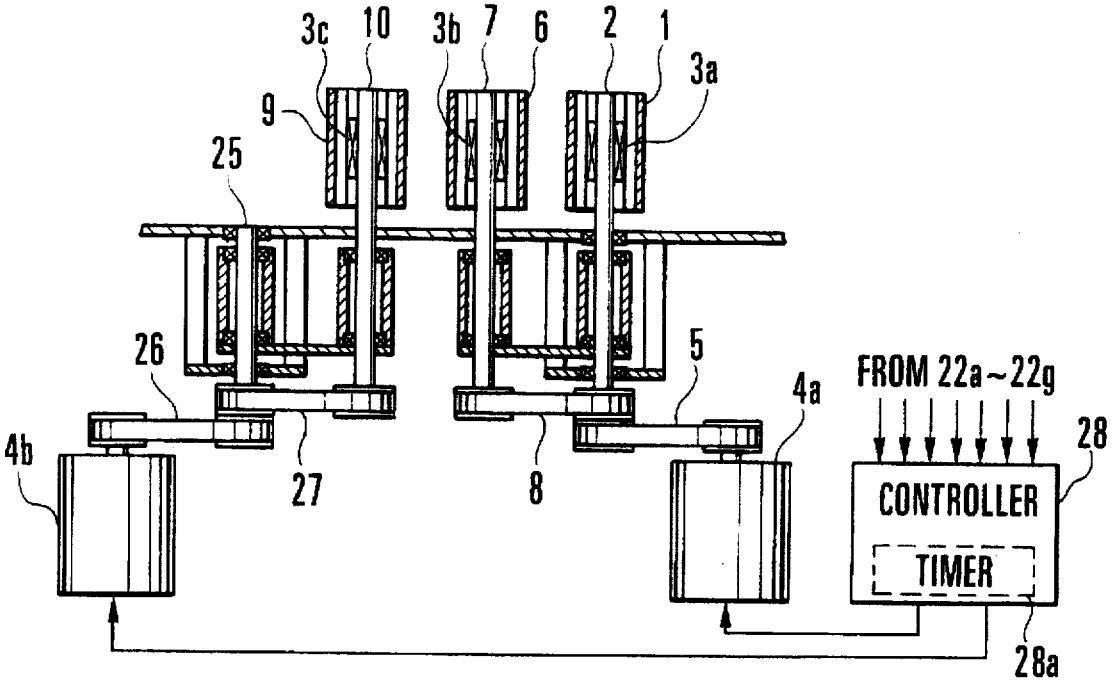
FIG. 2 is a sectional side view of the sheet feed mechanism of FIG. 1 seen from a direction of an arrow A.
Figure 3:
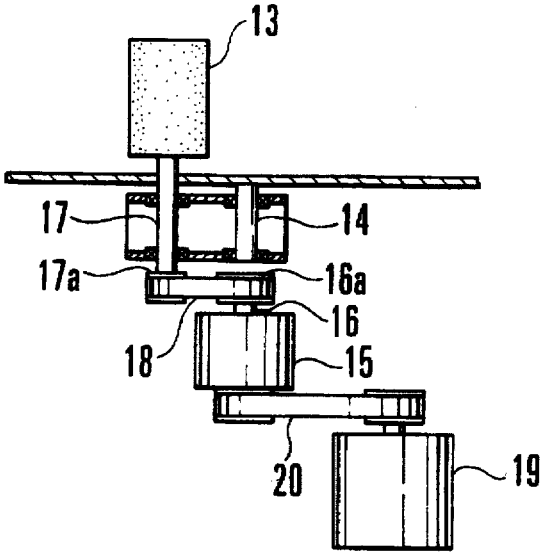
FIG. 3 is a sectional side view of the sheet feed mechanism of FIG. 1 seen from a direction of an arrow B.

FIG. 1 shows a sheet feed mechanism according to an embodiment of the present invention, FIG. 2 shows the sheet feed mechanism seen from the direction of an arrow A of FIG. 1, and FIG. 3 shows the sheet feed mechanism seen from the direction of an arrow B of FIG. 1.

Referring to FIGS. 1 and 2, a first feed roller 1 having a high-friction member on its outer circumference and driven by a one-way clutch 3*a* to rotate in only a feed direction is mounted on a driving shaft 2. The driving shaft 2 is coupled to a servo motor 4*a* through a timing belt 5 and can be started and stopped with a short period of time. A second feed roller 6 is arranged on the upstream side of the first feed roller 1 in the feed direction and is pivotal about the driving shaft 2 as the center. The second feed roller 6 has a high-friction member and a one-way clutch 3*b* in the same manner as the first feed roller 1, and is mounted on a driving shaft 7. Thus, the second feed roller 6 can press against mail piece 23*a* serving as a sheet which is stacked on a feed table 11 in an upright state to be able to come close to and separate from it, and can feed the mail piece 23*a* in the feed direction. The driving shafts 2 and 7 are coupled to each other through a timing belt 8.

A third feed roller 9 is arranged on the upstream side of the second feed roller 6 in the feed direction and is pivotal about a shaft 25 as the center. The third feed roller 9 presses against the mail piece 23*a* on the feed table 11 to be able to come close to and separate from it, has a high-friction member and a one-way clutch 3*c* in the same manner as the first feed roller 1, and is mounted on a driving shaft 10. The shaft 25 and the driving shaft 10 are coupled to each other through a timing belt 27. A servo motor 4*b* for driving the third feed roller 9 is coupled to the shaft 25 through a timing belt 26. The second feed roller 6 and the third feed roller 9 are biased by springs 12*a* and 12*b* mounted through arms 24*a* and 24*b* to press against the mail piece 23*a* stacked on the feed table 11 in the upright state with a predetermined spring pressure.

A reverse roller 13 having a high-friction member similar to that of the first feed roller 1 on its outer circumference presses against the first feed roller 1 with a predetermined spring pressure through a transport path, and is pivotal about a shaft 14 as the center. As shown in FIG. 3, a torque limiter 15 for applying a load torque to the reverse roller 13 is arranged to be concentric with the shaft 14, and its output shaft 16 and a rotating shaft 17 of the reverse roller 13 are coupled to each other through a timing belt 18. This torque transmitting structure applies a load torque to the reverse roller 13 and decreases the moment of inertia of the reverse roller 13 with respect to the shaft 14. The reverse roller 13 and the torque limiter 15 are coupled to each other through a pair of pulleys 16*a* and 17*a* at a reduction ratio of 1:2 so that the rotation speed of the torque limiter 15 is decreased. An induction motor 19 is coupled to the input shaft of the torque limiter 15 through a timing belt 20. The induction motor 19 is normally rotated in a direction to rotate the reverse roller 13 in a counter feed direction when the torque limiter 15 is coupled to it.

A pair of pick-up rollers 21 are driven by a motor (not shown) to transport to the downstream side each mail piece which is separated apart by the reverse roller 13. A sensor for detecting the position of the leading end of second or subsequent mail piece is arranged between the first feed roller 1 and the pair of pick-up rollers 21. In this embodiment, as the sensors, a plurality of photoelectric sensors 22*a* to 22*g* are arranged equidistantly to range from a position where the first feed roller 1 and the reverse roller 13 are brought into contact with each other to a position where the pair of pick-up rollers 21 oppose to contact each other.

A controller 28 controls the servo motors 4*a* and 4*b* based on outputs from the photoelectric sensors 22*a* to 22*g*, thereby controlling the mail piece 23*a* at a constant feed interval. Reference symbol 28*a* denotes a timer for counting the feed interval of the mail pieces.

The apparatus of this embodiment has the above arrangement. Assume that only one mail piece 23*a* enters between the first feed roller 1 and the reverse roller 13, as shown in FIG. 4A. The torque of the torque limiter 15, the spring pressure of the reverse roller 13, and the coefficients of friction of the high-friction members are set to satisfy $$F1=F2>F3$$

where F1 is a frictional force with which the first feed roller 1 transports the mail piece 23*a* in the feed direction, F2 is a frictional force with which the mail piece 23*a* rotates the reverse roller 13 in the feed direction, and F3 is a force with which the reverse roller 13 is rotated by the torque limiter 15 in the counter feed direction. Hence, the reverse roller 13 does not slip against the mail piece 23*a* but is rotated in the feed direction, so that the mail piece 23*a* is transported in the feed direction.

Figure 4B:
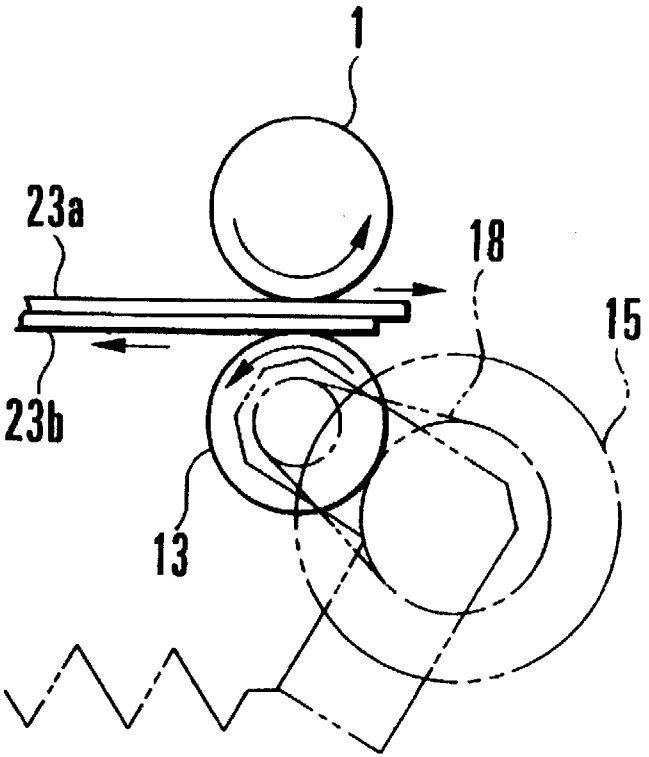
FIGS. 4A and 4B are diagrams for explaining a double transport preventing operation in the sheet feed mechanism shown in FIG. 1.
Figure 4A:
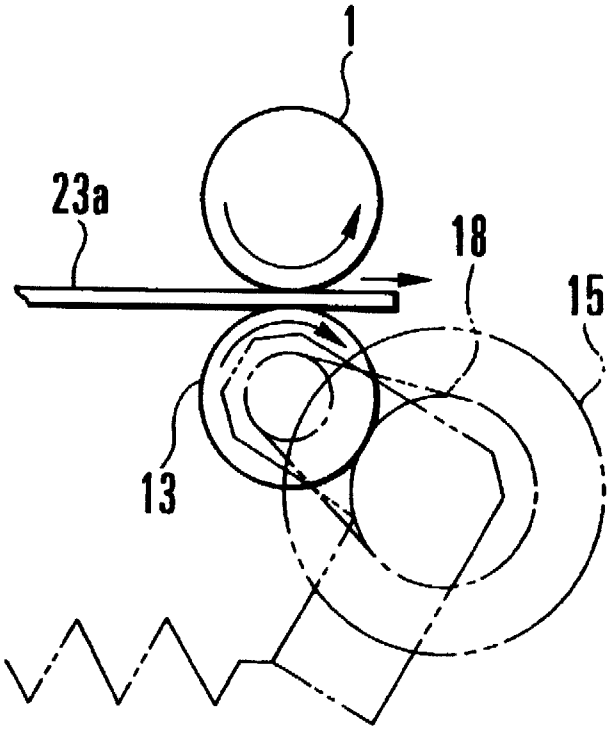

On the other hand, assume that the mail piece 23*a* and mail piece 23*b* enter between the first feed roller 1 and the torque limiter 15 simultaneously, as shown in FIG. 4B. In this case, the following relation is satisfied $$F1=F2>F3>F4$$

where F4 is the frictional force between the mail pieces 23a and 23b. Thus, although the mail piece 23a is directly transported in the feed direction, since the reverse roller 13 is rotated in a direction opposite to the feed direction, the mail piece 23b which presses against the reverse roller 13 slips against the mail piece 23a, and is returned to the feed table 11.

When the mail piece 23a has a large thickness, as the leading end of the mail piece 23a is abutted against the reverse roller 13, a large impact force acts on the reverse roller 13 due to a high transport speed. In the mechanism of this embodiment, however, as the torque limiter 15 is arranged to decrease the moment of inertia with respect to the shaft 14, the reverse roller 13 is not pivoted largely but follows the mail piece 23b, thereby separating the two mail pieces. As the torque limiter 15 is arranged to decrease the moment of inertia of the reverse roller 13 with respect to the shaft 14, rotation of the reverse roller 13 is switched from the feed direction to the counter feed direction instantaneously, so that the two mail pieces can be separated.

The transport operation of the mail piece 23b will be described with reference to the timing charts of FIGS. 5A to 5G. First, as shown in FIGS. 5A and 5B, the servo motors 4a and 4b are started by a feed start signal from the controller 28. Then, as shown in FIGS. 5C and 5D, the first, second, and third feed rollers 1, 6, and 9 are rotated in the feed direction to feed out the mail piece 23a. When the leading end of the mail piece 23a reaches a position where the first feed roller 1 and the reverse roller 13 are in contact with each other, a signal from the first photoelectric sensor 22a is changed, as shown in FIG. 5E, and the servo motor 4b is stopped (FIG. 5B). Thus, the third feed roller 9 is not driven (FIG. 5D). Even if the mail piece 23a has a small length and thus its leading end is not caught by the pair of pick-up rollers 21 yet when its trailing end is separated from the third feed roller 9, the second mail piece will not be fed out.

As shown in FIG. 5G, when the last photoelectric sensor 22g detects that the leading end of the mail piece 23a reaches the pair of pick-up rollers 21, the servo motor 4a is stopped (FIG. 5D), and the first and second feed rollers 1 and 6 are not driven. As the one-way clutches 3a, 3b, and 3c are provided between the first, second, and third feed rollers 1, 6, and 9 and the driving shafts 2, 7, and 10, respectively, the mail piece 23a is transported by the pair of pick-up rollers 21 without resistance.

The feed operation of the mail piece will be described with reference to the timing charts shown in FIGS. 5A to 5G. The controller 28 outputs a feed start signal to start the servo motors 4a and 4b, as shown in FIGS. 5A and 5B. Then, the first, second, and third feed rollers 1, 6, and 9 are rotated in the feed direction, as shown in FIGS. 5C and 5D, to start the feed operation of the mail piece 23a. Subsequently, when the photoelectric sensor 22a detects that the leading end of the mail piece 23a reaches the contact point of the first feed roller 1 and the reverse roller 13, as shown in FIG. 5E, the controller 28 stops the servo motor 4b (FIG. 5B). A driving torque is no longer applied to the third feed roller 9, and the feed operation by the third feed roller 9 is stopped. Therefore, when the trailing end of the mail piece 23a having a small length is separated from the third feed roller 9, even if its leading end is not caught by the pair of pick-up rollers 21 yet, the feed operation of the following mail piece can be prevented.

When the photoelectric sensor 22g detects that the leading end of the mail piece 23a reaches the pair of pick-up rollers 21, as shown in FIG. 5G, the controller 28 stops the servo motor 4a (FIG. 5D). A driving torque is no longer applied to the first and second feed rollers 1 and 6, and the feed operation of the first and second feed rollers 1 and 6 is stopped. However, since the first, second, and third feed rollers 1, 6, and 9 are respectively provided to the driving shafts 2, 7, and 10 through the one-way clutches 3a, 3b, and 3c and are thus free from the driving shafts 2, 7, and 10, the mail piece 23a is fed out by the pair of pick-up rollers 21 without resistance.

Figure 6:
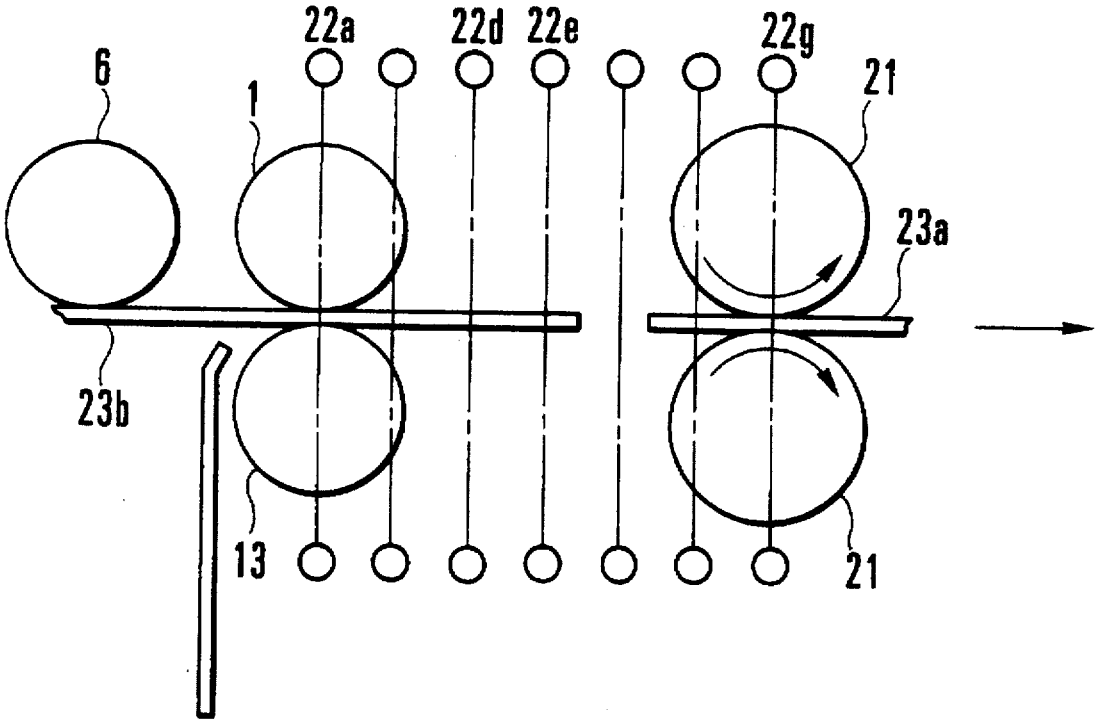
FIG. 6 is a diagram showing a mail piece feed state at time t in FIGS. 5A to 5G.
Figure 7A:
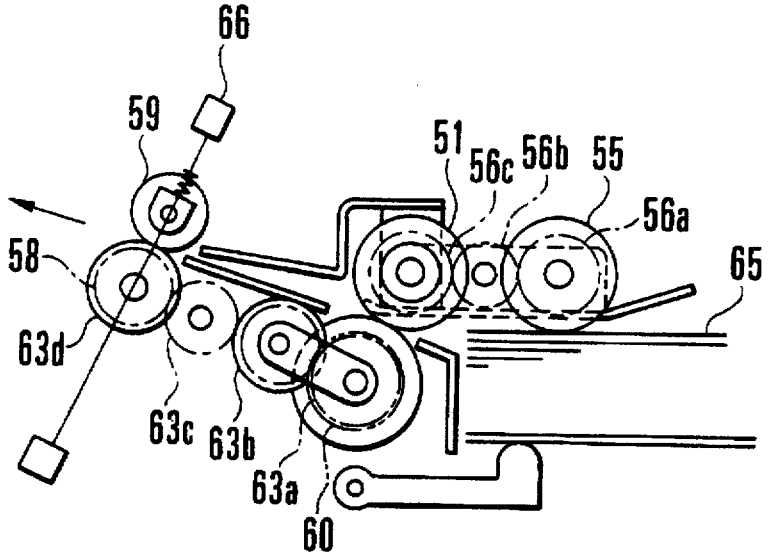
FIG.7A PRIOR ART
FIGS. 7A to 7C are front, sectional side, and perspective views, respectively, of a conventional sheet feed mechanism.
Figure 7B:
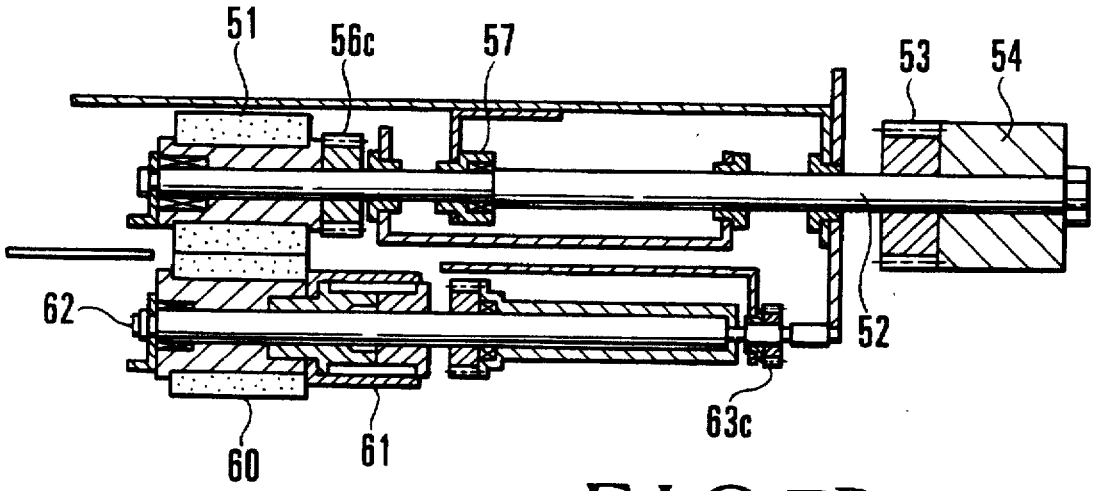
FIG.7B PRIOR ART
Figure 7C:
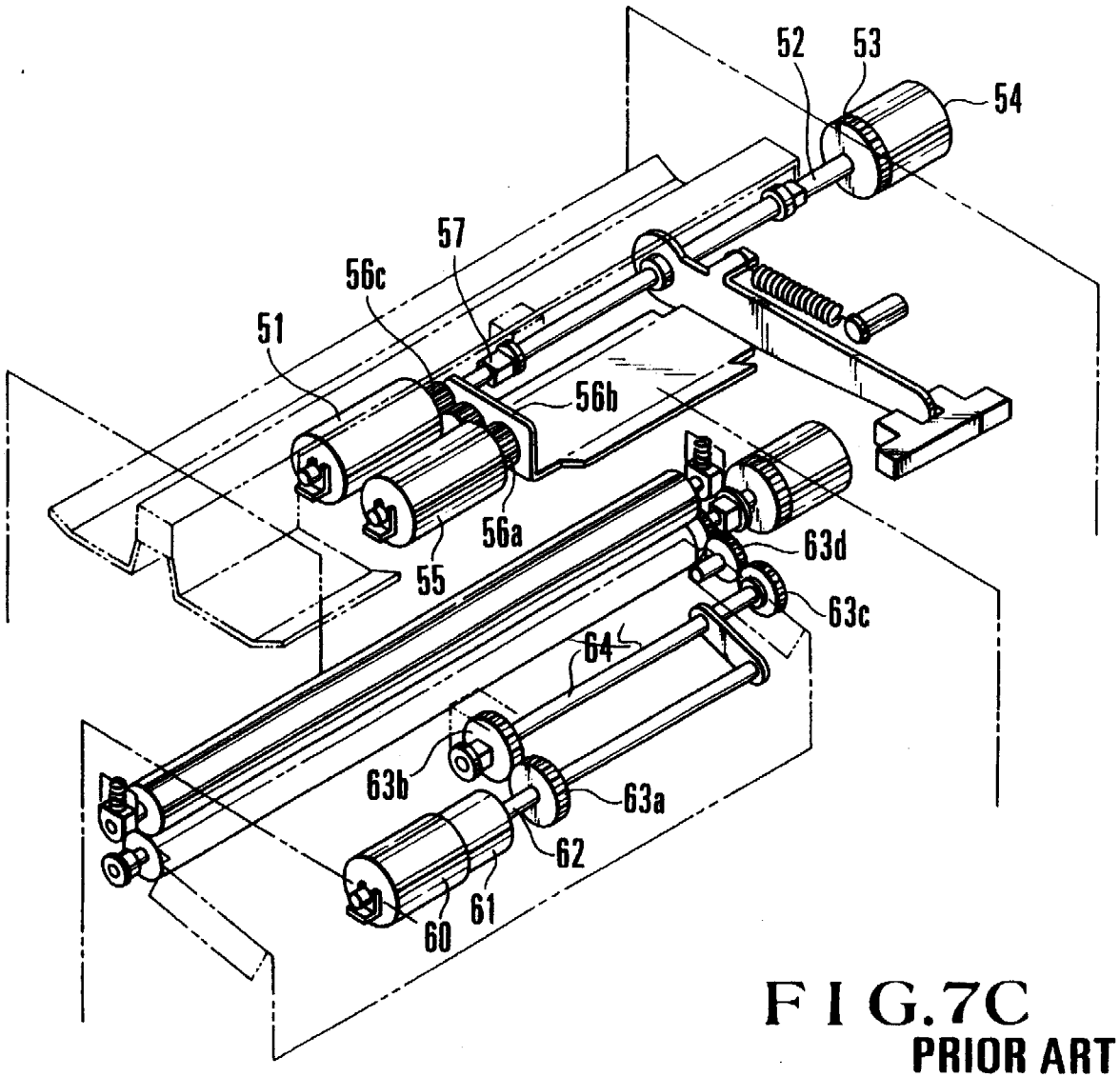
FIG.7C PRIOR ART

Double-feed operation in which following mail piece 23b is dragged by the preceding mail piece 23a will be described. In this case, the leading end of the following mail piece 23b does not always wait on the upstream side of the photoelectric sensor 22a in the feed direction. For example, when the mail piece 23b is dragged and fed such that its leading end reaches a position between the photoelectric sensors 22d and 22e, if the photoelectric sensor 22g detects the leading end of the mail piece 23a, the first, second, and third feed rollers 1, 6, and 9 are stopped, and the mail piece 23b waits before the photoelectric sensor 22e. When the mail piece 23a is fed by the pair of pick-up rollers 21 to eliminate the double feed state of the mail pieces 23a and 23b, an interval is formed between the mail pieces 23a and 23b, as shown in FIG. 6. When the photoelectric sensor 22e firstly detects the trailing end of the mail piece 23a, as shown in FIG. 5F, the controller 28 detects the photoelectric sensor 22e as the leading end position of the mail piece 23b. More specifically, when the controller 28 detects a change from a state wherein all the photoelectric sensors 22a to 22g detect the mail piece 23a and the mail piece 23b to a skate wherein only the photoelectric sensor 22e no longer detects the mail piece, the trailing end of the mail piece 23a immediately after being separated from the mail piece 23b is detected firstly. As the trailing end position of the mail piece 23a immediately before separation almost coincides with the leading end position of the mail piece 23b, the position of the photoelectric sensor 22e that firstly detected the trailing end of the mail piece 23a indicates the leading end position of the mail piece 23b.

Upon detection of the leading end position of the mail piece 23a, as described above, the controller 28 starts the timer 28a for counting a predetermined time T, and after a lapse of the predetermined time T outputs a feed start signal for the mail piece 23b, thereby starting the servo motors 4a and 4b (FIGS. 5A and 5B). Thus, in the predetermined period of time T after the detection of the trailing end of the mail piece 23a, the feed operation of the mail piece 23b is started, so that the mail piece 23a and the mail piece 23b are fed at a predetermined interval. In FIG. 5E, a broken line indicates an output from the photoelectric sensor 22a during double feed operation. If the following mail piece 23b is not dragged up to the position of the photoelectric sensor 22a, the timer 28a is started upon detection of the trailing end of the mail piece 23a by the photoelectric sensor 22a. In other words, except for the double feed operation, the photoelectric sensor 22a is regarded as the leading end position of the following photoelectric sensor 22b.

In this manner, since the wait position of the leading end of the mail piece 23b which is fed consecutively can be detected by arranging the plurality of photoelectric sensors 22a to 22g equidistantly, the mail pieces can always be fed at a predetermined interval. The precision of the feed interval depends on the mounting pitch of the photoelectric sensors, but the mounting pitch need not be defined by the photoelectric sensors. If the distance corresponding to the distance between the photoelectric sensors 22a and 22g is measured by, e.g., line sensors utilizing parallel laser light, the precision of the feed interval can be further improved.

Even if the mail piece 23*a* is heavy (about 50 g), it can be fed with two feed rollers (the second and third feed rollers 6 and 9) at the start of feeding at which a slip is most likely to occur between the mail piece and the feed roller. Thus, stable feed is enabled without causing a slip.

As has been described above, according to the present invention, the plurality of photoelectric sensors are arranged between the first feed roller and the pick-up rollers equidistantly, so that the sheet feed interval becomes constant and the processing speed is increased. When the moment of inertia with respect to the rotating shaft and the pivot shaft of the reverse roller is minimized, stable mail piece separation can be realized even in high-speed feeding. Furthermore, since the third feed roller and the servo motor which drives only the third feed roller independently are added, even heavy mail piece or short mail piece can be fed stably.

What is claimed is:

1. A sheet feed mechanism comprising:

a first feed roller mounted on a feed path of sheets including mail pieces and rotated by a first one-way clutch in only a feed direction, said first feed roller having a high-friction member on an outer circumference thereof;

a second feed roller arranged on an upstream side of said first feed roller in the feed direction to be pivotal about said first feed roller as a center and rotated by a second one-way clutch in only the feed direction, said second feed roller having a high-friction member on an outer circumference thereof and pressing against a sheet stacked on a feed table in an upright state to feed out the sheet in the feed direction;

a first servo motor for driving said first and second feed rollers;

a reverse roller pressed against by said first feed roller through said feed path and driven to rotate in a counter feed direction, said reverse roller being rotatable both in the feed direction and the counter feed direction;

a torque limiter for constantly applying a predetermined driving torque to said reverse roller in the counter feed direction;

a pick-up roller arranged on a downstream side of said first feed roller in the feed direction and constantly rotated to feed the sheet to a downstream transport path;

a third feed roller arranged on said upstream side of said second feed roller in the feed direction and rotated by a one-way clutch in only the feed direction, said third feed roller having a high-friction member on an outer circumference thereof and pressing against the sheet stacked on said feed table in the upright state;

a second servo motor for driving said third feed roller independently; and a plurality of photoelectric sensors sequentially arranged on said feed path between said first feed roller and said pick-up roller.

2. A mechanism according to claim 1, further comprising a controller for starting or stopping said first and second servo motors upon detection of a leading end position of a following sheet based on outputs from said plurality of photoelectric sensors, thereby controlling a feed interval of the sheets.

3. A mechanism according to claim 2, wherein a first photoelectric sensor located on a most upstream side in the feed direction among said photoelectric sensors is arranged at a position where said first feed roller and said reverse roller oppose each other, and a second photoelectric sensor located on a most downstream side in the feed direction among said photoelectric sensors is arranged at a position corresponding to said pick-up roller.

4. A mechanism according to claim 3, wherein said controller starts said first and second servo motors at a start of feeding the sheets, stops said second servo motor when said first photoelectric sensor detects a leading end of a sheet, and stops said first servo motor when said second photoelectric sensor detects a leading end of a sheet.

5. A mechanism according to claim 4, wherein said controller starts said first and second feed rollers a predetermined period of time after said plurality of photoelectric sensors first detect a trailing end of a sheet, thereby starting a feed operation of a following sheet.

6. A mechanism according to claim 4, wherein said controller detects a change from a state wherein all of said photoelectric sensors detect the sheet to a state wherein only one of said plurality of photoelectric sensors no longer detects the sheet, and determines a position of said photoelectric sensor that no longer detects the sheet as a position of a leading end of a following sheet.

7. A mechanism according to claim 1, wherein said photoelectric sensors are arranged at predetermined intervals.

8. A mechanism according to claim 1, further comprising a timing belt for transmitting a driving torque of said torque limiter to said reverse roller, and a pair of pulleys having a reduction ratio to decrease a rotation speed of said torque limiter, so that said torque limiter is provided to be concentric with a pivot shaft of said reverse roller.

* * * * *